US012195856B2

(12) United States Patent
Jadhav et al.

(10) Patent No.: US 12,195,856 B2
(45) Date of Patent: Jan. 14, 2025

(54) PASSIVATION COMPOSITION BASED ON TRIVALENT CHROMIUM

(71) Applicant: Henkel AG & Co. KGaA, Duesseldorf (DE)

(72) Inventors: Aditi Jadhav, Purnanagar (IN); Girdhari Kumar, Pune (IN); Priya Thakur, Pune (IN); Roshan Tukaram Lad, Mumbai (IN)

(73) Assignee: Henkel AG & Co. KGaA, Duesseldorf (DE)

( * ) Notice: Subject to any disclaimer, the term of this patent is extended or adjusted under 35 U.S.C. 154(b) by 926 days.

(21) Appl. No.: 17/097,020

(22) Filed: Nov. 13, 2020

(65) Prior Publication Data

US 2021/0062344 A1 Mar. 4, 2021

Related U.S. Application Data

(63) Continuation of application No. PCT/EP2019/061344, filed on May 3, 2019.

(30) Foreign Application Priority Data

May 18, 2018 (EP) ..... 18173093

(51) Int. Cl.
*C23C 22/30* (2006.01)
*C23C 22/18* (2006.01)
*C23C 22/24* (2006.01)

(52) U.S. Cl.
CPC ..... *C23C 22/182* (2013.01)

(58) Field of Classification Search
CPC ..... C23C 2222/10; C23C 22/30
See application file for complete search history.

(56) References Cited

U.S. PATENT DOCUMENTS

| | | | | |
|---|---|---|---|---|
| 2,559,878 | A | 7/1951 | Johnson | |
| 3,063,877 | A | 11/1962 | Schiffman | |
| 3,501,352 | A | 3/1970 | Shah | |
| 3,647,569 | A | 3/1972 | Schneider | |
| 3,932,198 | A | 1/1976 | Schneider | |
| 4,171,231 | A | 10/1979 | Bishop et al. | |
| 4,263,059 | A | 4/1981 | Guhde et al. | |
| 4,349,392 | A | 9/1982 | Huvar | |
| 4,359,345 | A | 11/1982 | Da Fonte, Jr. | |
| 4,359,346 | A | 11/1982 | Da Fonte, Jr. | |
| 4,359,347 | A | 11/1982 | Da Fonte, Jr. | |
| 4,359,348 | A | 11/1982 | Crotty | |
| 4,367,099 | A | 1/1983 | Lash et al. | |
| 4,384,902 | A | 5/1983 | Crotty et al. | |
| 4,578,122 | A | 3/1986 | Crotty | |
| 5,743,971 | A | 4/1998 | Inoue et al. | |
| 5,855,695 | A | 1/1999 | McMillen et al. | |
| 2003/0188807 | A1 | 10/2003 | Meagher | |
| 2011/0162556 | A1* | 7/2011 | Banda | C25D 3/06 106/1.25 |
| 2014/0360630 | A1 | 12/2014 | Arnold et al. | |
| 2017/0009363 | A1* | 1/2017 | Hiramatsu | C25D 5/48 |
| 2017/0314137 | A1 | 11/2017 | Schneider et al. | |

FOREIGN PATENT DOCUMENTS

| | | | | |
|---|---|---|---|---|
| CN | 10211112 | * | 4/2011 | C23C 22/06 |
| CN | 102011112 | A | 4/2011 | |
| CN | 102471890 | A | 5/2012 | |
| DE | 3213384 | A1 | 12/1982 | |
| DE | 19733972 | A1 | 2/1999 | |
| DE | 102007021364 | A1 | 11/2008 | |
| DE | 102010001686 | A1 | 8/2011 | |
| EP | 2014793 | A2 | 1/2009 | |
| EP | 2695970 | A1 | 2/2014 | |
| GB | 1461244 | A | 1/1977 | |
| IN | 102046842 | A | 5/2011 | |
| JP | 2005023372 | A | 1/2005 | |
| JP | 2013032554 | A | 2/2013 | |
| WO | 2008037236 | A1 | 4/2008 | |
| WO | 2015036124 | A1 | 3/2015 | |
| WO | 2015036125 | A1 | 3/2015 | |

OTHER PUBLICATIONS

International Search Report issued in connection with International Patent Application No. PCT/EP2019/061344 mailed Jul. 3, 2019.

* cited by examiner

*Primary Examiner* — Lois L Zheng
(74) *Attorney, Agent, or Firm* — Mary K. Cameron

(57) ABSTRACT

An aqueous passivation composition, having a pH of less than 3, comprising:

i) a source of trivalent chromium ions;

ii) at least one α-hydroxycarboxylic acid having general formula (I): $R_1CH(OH)COOH$ (I); wherein: $R_1$ represents a hydrogen atom, a C1-C4 alkyl group, a C2-C6 alkenyl group, a C1-C6 alkoxy group, a $C_3$-$C_6$ cycloalkyl group or a C6-C10 aryl group;

iii) phosphoric acid;

iv) at least one water-soluble polyphosphonic acid or a water-soluble salt thereof, said polyphosphonic acid having general formula (II): $Z—[—P{=}O(OH)_2]_n$ (II); in which: n is at least 2; and Z is a connecting organic moiety having an effective valency of n, said polyphosphonic acid including at least two phosphonic groups separated by an alkylene bridge having 1 or 2 carbon atoms ($C_1$-$C_2$ alkylene); and v) at least one divalent metal cation;

wherein said composition is substantially free of: nitrate and fluoride anions, and hexavalent chromium.

20 Claims, No Drawings

PASSIVATION COMPOSITION BASED ON TRIVALENT CHROMIUM

FIELD OF THE INVENTION

The present invention is directed to aqueous chromate passivation compositions containing trivalent chromium. More particularly, the invention is directed to aqueous, acidic passivation compositions that are characterized as being free of hexavalent chromium and free of nitrate and fluoride anions.

BACKGROUND OF THE INVENTION

The coating or plating of base metal substrates with a metal, such as zinc, in order to provide both a decorative finish and/or corrosion protection to that base metal substrate, is long established in the art. The standards of quality control for coated and plated substrates can, of course, be demanding and consumers will therefore closely scrutinize the finish and appearance of the treated surface. Having regard to protective coatings based on zinc and zinc alloys, a surface condition known as "wet storage stain" can be unsightly and can impair the further painting or coating of the substrate. This stain, which is also known as "white rust" or "black rust" (for Galvalume® coatings) is attributable to the formation of zinc oxide and zinc hydroxide and develops upon exposure of the deposited zinc or zinc alloy to atmospheric oxygen and moisture.

Techniques to obviate wet storage stain on newly galvanized substrates are known and include inter alia: the application of duplex or powder coatings; the application of waxes and oil, particularly for base metal substrates in the forms of sheets, beams and wires; and passivation treatments. The present invention is concerned with the treatment of zinc coatings or platings with chromate passivation compositions which, in addition to providing corrosion resistance, can provide a variety of color coatings—including blue, yellow, olive or black—and an effective base for subsequent dyeing and coating operations.

Upon applying an acidic chromate passivation solution to a zinc coated or plated substrate, surface zinc atoms are oxidized to form, in effect, an interfacial layer of hydrated basic chromium chromate ($Cr_2O_3CrO_3.xH_2O$) and hydrous oxides of both chromium and zinc. As the acid is consumed in the oxidation reaction, however, the pH at the surface-liquid interface increases: this diminishes the combining power of chromium in the aqueous phase and leads to the precipitation of a thin gelatinous film comprising chromium hydroxide and complexes of chromium ions and zinc. This film builds up until acid protons can no longer contact the zinc metal and the surface redox reactions are thereby stopped: the resulting gel-like film may then be permitted to harden.

Traditionally, hexavalent chromium ($Cr^{6+}$ or chromium (VI)) was used in passivation compositions to supply the chromium present in the passivation film or conversion coating. However, the toxicological properties of chromium (VI) are problematic and the use of chromium(VI)-containing passivation treatments has been strongly limited by inter alia EC directive 2000/53/EC. Consequently, there has been some focus in the art on the treatment of zinc surfaces with passivation compositions in which the chromium is at least partly in the trivalent state: mention in this regard may be made of the timeworn disclosures of: U.S. Pat. Nos. 2,559,878; 3,932,198; 3,647,569; 3,501,352; 4,359,345; 4,359,346; 4,359,347; 4,359,348; 4,349,392; 4,367,099; German Patent No. DE 2526832; and UK Patent No. GB 1,461,244. The Cr(III), as used in these citations, is not toxic and the concomitant waste removal of Cr(III) is not as expensive as that of hexavalent chromium.

Chromium (III) passivate compositions as described in the aforementioned patents nearly invariably employ peroxide-type oxidizing agents, such as $H_2O_2$, as necessary bath constituents. These and like oxidizing agents, such as persulphates, can promote some conversion of trivalent chromium to hexavalent chromium during the formation of the conversion coating. A further problem associated therewith is the high rate of consumption and loss of the peroxide or persulphate oxidizing agent which necessitates their frequent replenishment and moreover a careful control of the pH of the composition to obviate concomitant rise in pH. The consumption of peroxide (and persulphate) compounds is due in part to the presence of various activating metal ions—present in the solution as additives or contaminants—which tend to catalyze a decomposition of the oxidizing agent. The frequent replenishment of the peroxide and persulphate compounds represents an economic and energetic cost to the performance of the passivation or conversion process.

U.S. Pat. No. 4,263,059 A (Guhde et al.) describes aqueous acidic chromate coating solutions which are used in the treatment of zinc, zinc alloy, or cadmium surfaces. The solutions comprise: trivalent chromium as substantially the only chromium ion present; fluoride ion; and an acid, wherein the trivalent chromium ions are constituted by a mixture of green and blue trivalent chromium. A method of preparing the green trivalent chromium is proposed, said method comprising reducing an aqueous solution of hexavalent chromium with sufficient reducing agent to reduce all of the hexavalent chromium to trivalent chromium. The blue trivalent chromium can be prepared by reducing hexavalent chromium with reducing agent and adding an acid and fluoride ion (pH<1).

Fluoride anions are considered to be important accelerators in the formation of chromate passivation coatings and are present at the interface between the conversion coating and the metal matrix. In the teaching of Guhde et al., the sources of fluoride ion the solutions are hydrofluoric acid and metal and ammonium fluorides including: alkali metal fluorides, such as sodium fluoride; alkali metal hydrogen fluorides, sodium hydrogen fluoride; ammonium fluoride; and ammonium hydrogen fluoride. It is also known to introduce other soluble fluoride compounds, such as those having fluorine-containing anions: examples thereof include: fluorosilicic acid; fluorozirconic acid; fluorotitanic acid; and their metal salts, such as the salts of sodium, potassium and magnesium salts.

Despite the utility of the fluoride species in the passivation compositions, the environmental release of fluoride is problematic. Chronic or repeated exposure to hydrogen fluoride (hydrofluoric acid) has been associated with fluorosis, mottling of teeth, weight loss, malaise, anemia, leukopenia, osteosclerosis, skeletal changes such as increased bone density of the spine and pelvis, calcification of ligaments, hyperostosis, and liver or kidney damage (https://www.cdc.gov/niosh/).

U.S. Pat. No. 4,349,392 A (Huvar) describes an aqueous acidic solution which is utilized in a process for treating metal surfaces, in particular zinc and zinc alloy surfaces, to deposit a passivate film of improved clarity and hardness thereon and to impart improved corrosion resistance to said surfaces. The aqueous solution contains: effective amounts of chromium ions substantially all of which are in the trivalent state; hydrogen ions to provide a pH of about 1.2 to about 2.5; an oxidizing agent; a bath soluble and compatible organic carboxylic acid or metal salt thereof, present in an amount to impart increased initial hardness and improved clarity to the passivate film; and at least one additional metal ion selected from the group consisting of iron, cobalt, nickel, molybdenum, manganese, lanthanum, cerium and lanthanide. The aqueous acidic treatment solution may optionally further contain halide ions and a wetting agent.

U.S. Pat. No. 4,384,902 A (Crotty et al.) describes an aqueous acidic solution which is utilized in a process for treating metal surfaces, in particular zinc and zinc alloy surfaces, to deposit a passivate film of improved clarity and hardness thereon and to impart improved corrosion resistance to said surfaces. The aqueous solution contains: effective amounts of chromium ions substantially all of which are in the trivalent state; hydrogen ions to provide a pH of about 1.2 to about 2.5; an oxidizing agent; a bath soluble and compatible silicate compound, present in an amount to provide improved corrosion protection to the substrate and increased hardness to the passivate film; and at least one additional metal ion selected from the group consisting of iron, cobalt, nickel, molybdenum, manganese, lanthanum, cerium and lanthanide. The aqueous acidic treatment solution may optionally further contain halide ions, a carboxylic acid or salt and a wetting agent.

U.S. Pat. No. 4,578,122 A (Crotty) describes an aqueous acidic peroxide-free solution which is utilized in a process for treating receptive metal surfaces to impart a chromium passivate film thereon. The aqueous solution contains: chromium ions, substantially all of which are present in the trivalent state; hydrogen ions to provide a pH of about 1.2 to about 2.5; at least one additional metal ion selected from the group consisting of iron, cobalt, nickel, molybdenum, manganese, lanthanum, cerium and lanthanide, said ion(s) being present in an amount effective to activate the formation of the chromate passivate film; and nitrate ions as the essential oxidizing agent, said nitrate ions being present in an amount to provide a molar ratio of nitrate ions to the sum of chromium ions and activating metal ions of at least 4:1. The amount of nitrate ions should further be sufficient to activate the hydrated trivalent chromium to form a chromate film on the substrate. The aqueous acidic solution can optionally further contain controlled amounts of: sulfate ions; halide ions; organic carboxylic acids; a bath soluble and compatible silicate compound; and at least one wetting agent.

The presence of nitrate salts in the composition of U.S. Pat. No. 4,578,122 is considered highly disadvantageous. Such salts are converted to NOx during the spontaneous decomposition or the intended oxidation activity, and this NOx diffuses into the atmosphere as a pollutant.

Having regard to the above, there is a need in the art to develop passivation compositions in which the levels of both fluoride and fluorine-containing species and the levels of nitrate salts are minimized. Further, it would be optimal if the reduction of fluorides and nitrates in such developed compositions is not mitigated by elevated levels of peroxides, persulphates or like oxidizing agents.

SUMMARY OF THE INVENTION

In accordance with a first aspect of the invention there is provided an aqueous passivation composition for the treatment of zinc or zinc alloy coatings, said composition having a pH of less than 3 and comprising:

i) a source of trivalent chromium (Cr(III)) ions;

ii) at least one α-hydroxycarboxylic acid represented by the general formula (I):

$$R_1CH(OH)COOH \quad (I)$$

wherein: $R_1$ represents a hydrogen atom, a C1-C4 alkyl group, a C2-C6 alkenyl group, a C1-C6 alkoxy group, a $C_3$-$C_6$ cycloalkyl group or a C6-C10 aryl group;

iii) phosphoric acid;

iv) at least one water-soluble polyphosphonic acid or a water-soluble salt thereof, wherein said polyphosphonic acid has the general formula (II):

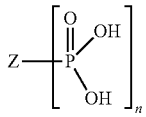

(II)

in which:

n is at least 2; and

Z is a connecting organic moiety having an effective valency of n, said polyphosphonic acid being characterized in that at least two phosphonic groups are separated by an alkylene bridge having 1 or 2 carbon atoms ($C_1$-$C_2$ alkylene); and v) at least one divalent metal cation, wherein said composition is characterized in that it is substantially free of nitrate and fluoride anions and is substantially free of hexavalent chromium (Cr(VI)).

In an important embodiment, which provides a highly stable chromate passivate film on zinc or zinc alloy coatings, there is provided an aqueous passivation composition having a pH of less than 3 comprising:

i) a source of trivalent chromium (Cr(III)) ions, wherein the concentration of trivalent chromium ions (Cr(III)) is from 0.005 to 0.1 moles/liter;

ii) at least one α-hydroxycarboxylic acid, wherein said least one α-hydroxycarboxylic acid is selected from the group consisting of glycolic acid, lactic acid, 2-hydroxybutanoic acid, 2-hydroxypentanoic acid and 2-hydroxyhexanoic acid, and wherein having regard to the carboxylic acid groups provided by said at least one α-hydroxycarboxylic acid, the molar ratio of said carboxylic acid groups to chromium (Cr) is in the range from 1:1 to 1.5:1;

iii) phosphoric acid;

iv) at least one water-soluble polyphosphonic acid or a water-soluble salt thereof, wherein said polyphosphonic acid is selected from a group consisting of aminotris (methylene phosphonic acid) (ATMP), 1-hydroxyethylidene-1,1-diphosphonic acid (HEDP), hexamethylene diamine tetra(methylene phosphonic acid) (HDTMP), diethylenetriamine penta(methylene phosphonic acid), diethylenetriamine penta(methylene-phosphonic acid (DTPM P) and mixtures thereof and wherein said at least one polyphosphonic acid or the water soluble salt thereof is included in the composition in an amount such that the molar ratio of phosphonate groups to phosphoric acid ($H_3PO_4$) in the composition is from the range from 1:0.75 to 1:1.25; and v) at least one divalent metal cation selected from the group consisting of $Mg^{2+}$, $Ca^{2+}$, $Mn^{2+}$, $Sr^{2+}$, $Ba^{2+}$ and $Zn^{2+}$, wherein the molar concentration of the divalent metal cations in the aqueous passivation composition is in the range from 0.01 to 1 moles/liter, wherein said composition is characterized in that it is substantially free of nitrate and fluoride anions and is substantially free of hexavalent chromium (Cr(VI)).

Good results have in particular been obtained when: said at least one α-hydroxycarboxylic acid of the composition comprises or consists of glycolic acid; and/or, said composition is further characterized in that it is substantially free of peroxide or persulphate compounds.

In accordance with a second aspect of the invention there is provided a process for imparting a chromate passivate film to a substrate to which a zinc or zinc alloy coating has been applied to at least one surface thereof, said process comprising contacting said at least one coated surface of the substrate with an aqueous composition as defined herein above and in the appended claims: the composition is applied at a temperature of from 20° C. to 90° C. for a period of time sufficient to form a passivate film thereon.

In accordance with a third aspect of the invention, there is provided a passivated substrate obtained by the process defined herein above and in the appended claims.

Definitions

As used herein, the singular forms "a", "an" and "the" include plural referents unless the context clearly dictates otherwise.

The terms "comprising", "comprises" and "comprised of" as used herein are synonymous with "including", "includes", "containing" or "contains", and are inclusive or open-ended and do not exclude additional, non-recited members, elements or method steps.

When amounts, concentrations, dimensions and other parameters are expressed in the form of a range, a preferable range, an upper limit value, a lower limit value or preferable upper and limit values, it should be understood that any ranges obtainable by combining any upper limit or preferable value with any lower limit or preferable value are also specifically disclosed, irrespective of whether the obtained ranges are clearly mentioned in the context.

The words "preferred", "preferably", "particularly" and "desirably" are used frequently herein to refer to embodiments of the disclosure that may afford particular benefits, under certain circumstances. However, the recitation of one or more preferable, preferred, particular or desirable embodiments does not imply that other embodiments are not useful and is not intended to exclude those other embodiments from the scope of the disclosure.

The present compositions are defined herein as being "substantially free" of certain compounds, elements, ions or other like components. The term "substantially free" is intended to mean that the compound, element, ion or other like component is not deliberately added to the composition and is present, at most, in only trace amounts which will have no (adverse) effect on the desired properties of the coating. The term "substantially free" encompasses those embodiments where the specified compound, element, ion, or other like component is completely absent from the composition or is not present in any amount measurable by techniques generally used in the art.

As used herein, room temperature is 23° C. plus or minus 2° C.

As defined herein, the term "conversion coating" or "conversion treatment," refers to a treatment of the surface of a substrate which causes the surface material to be chemically converted to a different material. The term "passivation" refers to a treatment of the surface of a substrate to form a barrier layer to corrosive conditions on said surface but without a cohesive film forming a chemical bond between the surface and the passivation layer.

The term "passivation composition" as used herein refers to that composition which actually contacts the zinc-coated or zinc-alloy coated substrate. As is known in the art, such contacting occurs in a so-called "bath" which is shaped, sized and disposed to enable at least part of the substrate to be immersed therein. The passivation bath should moreover be sized to allow for movement of the composition around and throughout the loaded substrate, which movement can be further enhanced with recirculation and/or ultrasonics. The pH of the composition within the bath, the temperature of the bath, and contact time of the substrate are result effective variables which should be monitored either manually or automatically, whenever possible.

Viscosities of the passivation compositions may be determined using the Brookfield Viscometer, Model RVT at standard conditions of 20° C. and 50% Relative Humidity (RH). The viscometer is calibrated using silicone oils of known viscosities, which vary from 5,000 cps to 50,000 cps. A set of RV spindles that attach to the viscometer are used for the calibration. Measurements of the passivation compositions are done using the No. 6 spindle at a speed of 20 revolutions per minute for 1 minute until the viscometer equilibrates. The viscosity corresponding to the equilibrium reading is then calculated using the calibration.

Unless otherwise stated, where a molar ratio is given herein with respect "to chromium", this refers to the total content of chromium in the composition, independent of the oxidation state(s) of that metal.

As used herein, the term "alloy" refers to a substance composed of two or more metals or of a metal and a non-metal which have been intimately united, usually by being fused together and dissolved in each other when molten. The term "zinc alloy" therefore denotes an alloy of which zinc metal is a constituent component, which zinc will generally comprise at least 40 wt. %—more typically at least 50 wt. % or at least 60 wt. %—of the alloy, on a metals basis. Metals which may be alloyed with zinc include, but are not limited to, aluminum, tin, nickel, titanium and cobalt.

Herein, for a zinc/aluminum alloy, it is preferred that zinc constitutes, on a metals basis, at least 40 wt. % of the alloy and conversely that aluminum constitutes, on a metals basis, up to 60 wt. % of the alloy. For a zinc/tin alloy, it is preferred that zinc constitutes, on a metals basis, at least 70 wt. % and more particularly at least 80 wt. % of the alloy and conversely that tin constitutes, on a metals basis, up to 30 wt. % and more particularly up to 20 wt. % of the alloy.

Herein, for a zinc/titanium alloy, it is preferred that zinc constitutes, on a metals basis, at least 85 wt. % and more particularly at least 90 wt. % of the alloy and conversely that titanium constitutes, on a metals basis, up to 15 wt. % and more particularly up to 10 wt. % of the alloy. For a zinc/nickel alloy, it is similarly preferred that zinc constitutes, on a metals basis, at least 85 wt. % and more particularly at least 90 wt. % of the alloy and conversely that nickel constitutes, on a metals basis, up to 15 wt. % and more particularly up to 10 wt. % of the alloy. For a zinc/cobalt alloy, it is preferred that zinc constitutes, on a metals basis, at least 95 wt. % of the alloy and conversely that cobalt constitutes, on a metals basis, up to 5 wt. % of the alloy.

As used herein, "phosphoric acid" refers to ortho-phosphoric acid having the formula $H_3PO_4$, which acid is typically available as an aqueous solution having a concentration up to 75 wt. % $H_3PO_4$. As used herein "phosphonic acid" refers to the phosphorus oxoacid having the formula $H_3PO_3$ that consists of a single pentavalent phosphorus covalently bound via single bonds to a single hydrogen and two hydroxy groups and via a double bond to an oxygen.

As used herein, the term "α-hydroxycarboxylic acid" means a carboxylic acid having at least one hydroxyl functional group occupying an α-position on said acid (carbon adjacent to a carboxylic acid functional group). This α-hydroxycarboxylic acid is included in the present composition in the form of the free acid.

The term "hydrocarbyl group" is used herein in its ordinary sense, which is well-known to those skilled in the art.

As used herein, the term "$C_6$-$C_{10}$ aryl group" refers to an aromatic monocyclic or multicyclic ring system of 6 to 10 carbon atoms. The "aryl group" may optionally be substituted with one or more $C_1$-$C_{12}$ alkyl, alkylene, alkoxy, or haloalkyl groups. Exemplary aryl groups include phenyl or naphthyl, or substituted phenyl or substituted naphthyl.

Unless otherwise indicated, the term "alkyl", as used herein, includes straight chain moieties, and where the number of carbon atoms suffices, branched moieties. The alkyl group may optionally be substituted. As such, the term "$C_1$-$C_4$ alkyl" includes saturated straight chain and branched alkyl groups having from 1 to 4 carbon atoms. Examples of $C_1$-$C_4$ alkyl groups include methyl, ethyl, propyl, isopropyl, butyl, isobutyl and tert-butyl.

The terms "alkylene group" refers to a group that are radicals of a linear, branched or cyclic alkane, which group may be substituted or unsubstituted and may optionally be interrupted by at least one heteroatom.

As used herein, "$C_2$-$C_6$ alkenyl" group refers to an aliphatic carbon group that contains 2 to 6 carbon atoms and at least one double bond disposed in any position. Like the aforementioned alkyl group, an alkenyl group can be straight or branched, and may optionally be substituted. The term "alkenyl" also encompasses radicals having "cis" and "trans" configurations, or alternatively, "E" and "Z" configurations, as appreciated by those of ordinary skill in the art. In general, however, a preference for unsubstituted alkenyl groups containing from 2 to 6 (C2-06) or from 2 to 4 ($C_2$-$C_4$) carbon atoms should be noted. And Examples of $C_2$-$C_6$ alkenyl groups include, but are not limited to: ethenyl; 1-propenyl; 2-propenyl; 1-methyl-ethenyl; 1-butenyl; 2-butenyl; 4-methylbutenyl; 1-pentenyl; 2-pentenyl; 3-pentenyl; 4-pentenyl; 4-methyl-3-pentenyl; 1-hexenyl; 3-hexenyl; and 5-hexenyl.

The term "$C_3$-$C_6$ cycloalkyl" as used herein means an optionally substituted, saturated cyclic hydrocarbon having 3-6 carbon atoms. Exemplary cycloalkyl groups include cyclopropyl, cyclobutyl, cyclopentyl or cyclohexyl groups.

The term "alkoxy", as used herein, means "—O-alkyl" or "alkyl-O—", wherein "alkyl" is defined as above.

The term "substituted" refers to substitution with at least one suitable substituent. For completeness: the substituents may connect to the specified group or moiety at one or more positions; and multiple degrees of substitution are allowed unless otherwise stated. Further, the terms "substitution" or "substituted with" include the implicit proviso that such substitution is in accordance with permitted valence of the substituted atom and the substituent, and that the substitution results in a stable compound that does not spontaneously undergo transformation by, for instance, rearrangement, cyclization or elimination.

Having regard to the α-hydroxycarboxylic acid defined above and hereinbelow, substitutions of the group $R_1$ will conventionally be selected from the group consisting of: halogen; oxo; —OH; and —COOH.

Where mentioned, the expression "interrupted by at least one heteroatom" means that the main chain of a residue comprises, as a chain member, at least one atom that differs from carbon atom. More particularly the term "heteroatom" refers to nitrogen, oxygen, halogens, phosphorus or sulfur. Oxygen (O) and nitrogen (N) may be mentioned as typical heteroatoms in the context of the present invention.

DETAILED DESCRIPTION OF THE INVENTION

The Passivation Composition

Component i)

The trivalent chromium ions can be directly introduced to the passivation composition in the form of a bath soluble and compatible compound: salts such as chromium sulfate ($Cr_2(SO_4)_3$), chromium alum ($KCr(SO_4)_2$), chromium chloride ($CrCl_3$) and chromium bromide ($CrBr_3$) are particularly suitable for this purpose.

In an alternative, but not necessarily mutually exclusive embodiment, the trivalent chromium is introduced into the passivation composition through the reduction of an aqueous hexavalent chromium-containing solution. There is no particular intention to limit the sources of hexavalent chromium which may be used, save that the anions or cations introduced with the hexavalent chromium should not have a detrimental effect on either the composition itself or on the coated zinc obtained therefrom. Exemplary hexavalent chromium materials include but are not limited to: chromium (VI) oxide; alkali metal chromates, in particular sodium chromate and potassium chromate; and alkali metal dichromates, in particular sodium dichromate and potassium dichromate. These materials may be used alone or in combination.

Methods for reducing hexavalent chromium with inorganic reducing agents and organic reducing agents—including amine based compounds, such as hydrazine and hydroxylamine—are known in the art and do not require substantial elucidation here. Particularly instructive methods are, by way of non-limiting examples, described in UK Patent No. GB 1,461,244 and U.S. Pat. No. 4,171,231, the disclosures of which are herein incorporated by reference. It will be recognized that those prior art redox methods may require modification in the amounts of reducing agent used to ensure complete reduction of the chromium (VI), as required in the present invention. For instance, U.S. Pat. Nos. 3,063,877 and 3,501,352 describe methods for the incomplete reduction of chromium (VI) oxide with aldehydes and alcohols, such as formaldehyde, sorbitol and butyl alcohol: the amount of said reducing agents needs to be increased to ensure complete reduction of the hexavalent chromium to trivalent chromium. In that regard, whilst the exact stoichiometric amount of reducing required for complete reduction of hexavalent to trivalent chromium can be used, it is preferred that a stoichiometric excess of up to 1 mol. % of the reducing agents be employed.

For completeness, it is noted that suitable inorganic reducing agents include but are not limited to: alkali metal iodides; tin (II) compounds, such as $SnSO_4$ and $SnCl_2.2H_2O$; antimony (III) compounds; ferrous salts, such as ferrous sulphate heptahydrate (HH), ferrous sulphate monohydrate (MH) and ammonium ferrous sulphate; sulfur dioxide; and alkali metal sulfites, bisulfites and metabisulfites as well as α-hydroxycarboxylic acids according to component ii). Of these, α-hydroxycarboxylic acids according to component ii), especially glycolic acid, are preferred as will be outlined in the next section.

The concentration of the trivalent chromium ions in the passivation composition will conventionally be from 0.001 moles/liter up to saturation; concentrations of from 0.005 to 0.1 moles/liter, for example from 0.01 to 0.05 moles/liter are preferred.

Component ii)

The composition of the present invention comprises at least one α-hydroxycarboxylic acid represented by the general formula (I):

$$R_1CH(OH)COOH \quad (I)$$

wherein: R1 represents a hydrogen atom, a C1-C4 alkyl group, a C2-C6 alkenyl group, a C1-C6 alkoxy group, a $C_3$-$C_6$ cycloalkyl group or a C6-C10 aryl group.

Suitable α-hydroxycarboxylic acids include but are not limited to: glycolic acid; lactic acid (2-hydroxypropanoic acid); 2-hydroxybutanoic acid; 2-hydroxypentanoic acid; 2-hydroxyhexanoic acid; glucuronic acid; citric acid; mandelic acid; galacturonic acid; ribonic acid (2,3,4,5-tetrahydroxypentanoic acid); tartronic acid; tartaric acid; and malic acid.

In a preferred embodiment, said at least one α-hydroxycarboxylic acid is selected from the group consisting of: glycolic acid; lactic acid (2-hydroxypropanoic acid); 2-hydroxybutanoic acid; 2-hydroxypentanoic acid; and 2-hydroxyhexanoic acid. More particularly, the α-hydroxycarboxylic acid(s) of the coating composition should comprise or consist of glycolic acid.

The α-hydroxycarboxylic acids are preferably included in the compositions in an amount such that the molar ratio of carboxylic acid groups to chromium is in the range from 1:10 to 1:2. For example, α-hydroxycarboxylic acids having one carboxylic acid group, such as glycolic acid and the other aforementioned preferred acids, may be included in the compositions such that the molar ratio of carboxylic acid groups to chromium is from 1:10 to 1:2, more preferably from 2:10 to 2:5.

Surprisingly, it was found that the α-hydroxycarboxylic acids are effective reducing agents and readily convert a hexavalent chromium containing solution to a passivation solution of this invention. In this respect, it was observed that a passivation solution of this invention that is obtained from aqueous solutions comprising hexavalent chromium after reduction in the presence of a molar excess amount of α-hydroxycarboxylic acid, especially glycolic acid, provide highly stable solutions which is a clear benefit when concentrated passivation solutions with a less amount of water are to be prepared.

Consequently, the present invention also encompasses a passivating solution having a pH of less than 3 comprising:

i) a source of trivalent chromium (Cr(III)) ions;

ii) at least one α-hydroxycarboxylic acid represented by the general formula (I):

$$R1CH(OH)COOH \quad (I)$$

wherein: R1 represents a hydrogen atom, a C1-C4 alkyl group, a C2-C6 alkenyl group, a C1-C6 alkoxy group, a C3-C6 cycloalkyl group or a C6-C10 aryl group;

iii) phosphoric acid;

iv) at least one water-soluble polyphosphonic acid or a water-soluble salt thereof, wherein said polyphosphonic acid has the general formula (II):

(II)

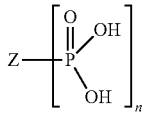

in which:

n is at least 2; and

Z is a connecting organic moiety having an effective valency of n, said polyphosphonic acid being characterized in that at least two phosphonic groups are separated by an alkylene bridge having 1 or 2 carbon atoms (C1-C2 alkylene); and v) at least one divalent metal cation, wherein said composition is characterized in that it is substantially free of nitrate and fluoride anions and is substantially free of hexavalent chromium (Cr(VI)); wherein said composition is obtainable through mixing a portion comprising hexavalent chromium dissolved in water with an amount of α-hydroxycarboxylic acids according to component ii), preferably comprising or consisting of glycolic acid, in molar excess preferably to such extend that a molar ratio of carboxylic acid groups to chromium in the range from 1.1:1 to 1.5:1, more preferably from 1.2:1 to 1.4:1 is established and thereafter adding the components iii) to v) to said mixture.

Component iii)

The composition comprises by necessity phosphoric acid. The added amount thereof is that required to adjust the pH of the passivation composition to a value of less than 3, in particular to a pH of from 1 to 3 or from 1.2 to 2.8.

Component iv)

A further essential component of the composition of the present invention is constituted by at least one water-soluble polyphosphonic acid or a water-soluble salt thereof, wherein said polyphosphonic acid has the general formula (II):

(II)

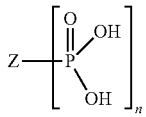

in which:

n is at least 2; and

Z is a connecting organic moiety having an effective valency of n, said polyphosphonic acid being characterized in that at least two phosphonic groups are separated by an alkylene bridge having 1 or 2 carbon atoms ($C_1$-$C_2$ alkylene).

In particular embodiments, n is an integer from 2 to 5 or, preferably, either 2 or 3. Most desirably, said polyphosphonic acid is selected from a group consisting of aminotris (methylene phosphonic acid) (ATMP); 1-hydroxyethylidene-1,1-diphosphonic acid (HEDP); hexamethylene diamine tetra(methylene phosphonic acid) (HDTMP); diethylenetriamine penta(methylene phosphonic acid); diethylenetriamine penta(methylenephosphonic acid (DTPMP); and mixtures thereof. A particular preference for the use of 1-hydroxyethylidene-1,1-diphosphonic acid (HEDP) should be noted.

Suitable water soluble salts of the aforementioned polyphosphonic acids include the sodium, potassium, calcium, magnesium, ammonium, triethanolammonium, diethanolammonium and monoethanolammonium salts.

The polyphosphonic acids or the water soluble salts thereof are preferably included in the compositions in an amount such that the molar ratio of phosphonate groups to phosphoric acid ($H_3PO_4$) in the composition is in the range from 1:0.75 to 1:1.25, more preferably in the range from 1:0.8 to 1:1.2 and most preferably from 1:0.9 to 1:1.1. It is noted that these preferred ranges each encompass a molar ratio of phosphonate groups to phosphoric acid ($H_3PO_4$) of 1:1: compositions at or near a molar ratio of 1:1 have been found to be stable without promoting substantial etching of the coated substrates to which they are applied.

Component v)

The passivation composition further contains at least one divalent metal cation. In preferred embodiments, said least one divalent metal cation is selected from the group consisting of: $Mg^{2+}$; $Ca^{2+}$; $Mn^{2+}$; $Sr^{2+}$; $Ba^{2+}$; and $Zn^{2+}$, preferably from the group consisting of $Mg^{2+}$, $Mn^{2+}$ and $Zn^{2+}$, more preferably from $Mn^{2+}$ and/or $Zn^{2+}$, most preferably from $Mn^{2+}$. The foregoing metal ions or mixtures thereof are most conveniently introduced into the composition as metal oxides, metal hydroxides and/or soluble and compatible metal salts, including but not limited to sulfate and halide salts. The use of nitrate and fluoride salts for this purpose is of course precluded.

The molar concentration of the divalent metal cations in the aqueous composition is conventionally in the range from 0.01 to 1 moles/litre but more typically is from 0.01 to 0.5 moles/litre.

Adjunct Ingredients

In the addition to the aforementioned α-hydroxycarboxylic acids, the composition of the present invention may optionally contain at least one further carboxylic acid (III), wherein said further carboxylic acid is an alkyl, aryl, alkenyl or alkynyl carboxylic acid which is characterized in that it does not contain polar, in particular protic, groups with exception of the carboxylic group(s). In particular, said further carboxylic acid should not contain any of the following groups: —OH, —$SO_3H$, —$NH_2$, —$NHR^3$, —$N(R^3)_2$ or —$N(R^3)_3^+$, wherein each $R^3$ independently represents a $C_1$-$C_6$ alkyl group. Said carboxylic acid (II) may, however, contain the following groups: halogen; alkyl; aryl; vinyl; alkoxy; and nitro groups.

Examples of acids which are suitable as said carboxylic acid (II) include, but are not limited to: formic acid; acidic acid; propionic acid; butyric acid; iso-butyric acid; valeric acid; hexanecarboxylic acid; cyclopentanecarboxylic acid; acetylsalicylic acid; benzoic acid; nitrobenzoic acid; 3,5-dinitrobenzoic acid; sorbic acid; trifluoracetic acid; 2-ethylhexanoic acid; acrylic acid; chloroacetic acid; 2-chlorobenzoic acid; 2-chloro-4-nitrobenzoic acid; cyclopropanecarboxylic acid; methacrylic acid; 3-nitrobenzoic acid; phenoxyacetic acid; isovaleric acid; pivelinic acid; 2-ethylbutyric acid; furan-2-carboxylic acid; bromoacetic acid; crotonic acid; 2-chloropropionic acid; dichloroacetic acid; glyoxylic acid; 4-methoxybenzoic acid; 3,4-dimethoxybenzoic acid; levulinic acid; pentenoic acid; phenylacetic acid; tiglic acid; and vinylacetic acid.

When added to the present compositions, said further carboxylic acid(s) (II) should in toto only be present in an amount up to 10 mol. %, preferably up to 5 mol. %, based on the total number of moles of the α-hydroxycarboxylic acid.

In addition to the aforementioned phosphoric acid, the passivation compositions may comprise one or more further mineral acids: the use of nitric acid is precluded but, conversely, the addition of phosphonic or sulphuric acid is considered to be particularly suitable. The above recited pH of the passivation composition is somewhat determinative of the added amount of such acid(s). Within that pH constraint, the presence of phosphonate or sulphate ions in the treatment bath in concentrations of up to 5% by weight and, more particularly, between 0.1 and 3% by weight can be advantageous.

The present compositions may further comprise additives which are conventional in this field; in particular, the compositions might comprise: corrosion inhibitors, such as dialkylthioureas, cupric sulphate and copper sulphate; adhesion promoters; non-ionic surfactants; wetting agents; defoaming agents; sequestrants; lubricants; and mixtures thereof. That aside, any such additives are necessarily minor ingredients of the present compositions and, when used, should only be used in amounts which are not deleterious to the performance of the composition and the coating derived there from.

Preparation of the Passivation compositions

The aqueous passivation compositions are formulated by simple mixing of the various components i) to v) as well as any adjunct ingredients. In an alternative route, the passivation compositions of this invention can be obtained through mixing a portion comprising hexavalent chromium (Cr(VI)) dissolved in water with an amount of α-hydroxycarboxylic acids according to component ii), preferably comprising or consisting of glycolic acid, in molar excess preferably to such extend that a molar ratio of carboxylic acid groups to chromium in the range from 1.1:1 to 1.5:1, more preferably from 1.2:1 to 1.4:1 is established and thereafter adding the components iii) to v) to said mixture.

If necessary, the passivation composition may be prepared well in advance of its application. However, in an interesting alternative embodiment, a concentrated passivation composition may first be obtained by mixing components with only a fraction of the water that would be present in the passivation composition as applied: the concentrated passivation composition may then be diluted with the remaining water shortly before its introduction into the passivation bath. It is considered that such concentrated passivation compositions may be prepared and stored as either single-package concentrates—that can be converted by dilution with water only—or as multi-part concentrates, two or more of which must be combined and diluted to form a complete working composition according to the invention. Any dilution can be affected simply by the addition of water, in particular deionized and/or demineralized water, under mixing. The passivation composition might equally be prepared within a rinse stream whereby one or more streams of the concentrate(s) is injected into a continuous stream of water.

Without specific intention to limit the amount of water included in the passivation compositions, it is preferred that said compositions contain from 40 to 90 wt. %, more preferably from 50 to 80 wt. %, based on the weight of the composition, of water. In an alternative but not mutually exclusive characterization, the passivation composition may be defined by a viscosity of from 0.005 to 1 Pa·s (50 cps to 1000 cps), as measured using a Brookfield viscometer at 25° C.

Methods and Applications

Whilst the present invention is concerned with passivating of surfaces of zinc or zinc alloys, there is no intention to limit the base substrate to which that zinc or zinc alloy may have been applied nor the method of such application. As such, suitable base metal substrates may include but not be limited to iron, nickel, copper, aluminum and alloys thereof. Such metals and alloys may be provided in various forms, including sheets, plates, cuboids, spheres, solid cylinders, tubes and wires. Moreover, the plating or coating of zinc or zinc alloy may be applied to such base substrates by: electroplating; galvanizing, including hot-dip galvanizing and thermal diffusion galvanizing; and galvannealing. By way of example only, the passivation compositions and methods of the present invention may have utility in the treatment of: GALVALUME®, a 55% Al/43.4% Zn/1.6% Si alloy coated sheet steel available from Bethlehem Steel Corporation; and GALFAN®, a 5% Al/95% Zn alloy coated sheet steel available from Weirton Steel Corporation.

In accordance with process aspects of the present invention, it is often advisable to remove foreign matter from the coated or plated metal substrate by cleaning and degreasing the relevant surfaces. Such treatments are known in the art and can be performed in a single or multi-stage manner constituted by, for instance, the use of one or more of: a waterborne alkaline degreasing bath; a waterborne cleaning emulsion; a cleaning solvent, such as carbon tetrachloride or trichloroethylene; and a water rinse, preferably of deionized or demineralized water. In those instances where a waterborne alkaline degreasing bath is used, any of the degreasing agent remaining on the surface should desirably be removed by rinsing the substrate surface with deionized or demineralized water. Irrespective of the cleaning or degreasing agent applied, the so-treated substrate should not be subjected to an intermediate drying step prior to either the passivation treatment or to any subsequent pre-treatment step which precedes said passivation treatment.

As therefore intimated above, the present invention does not preclude the pre-treatment of the zinc or zinc alloy surface, independently of the performance of cleaning and/or degreasing steps. Such pre-treatments are known in the art and reference in this regard may be made to: German Patent Application No. DE 197 33 972 A1; German Patent Application No. DE 10 2010 001 686 A1; German Patent Application No. DE 10 2007 021 364 A1; and US Patent Application Publication No. 2014/360630.

After said cleaning, degreasing and/or pre-treatment steps, a trivalent chromium operating bath as hereinbefore described prepared and the passivation composition is applied to the substrate by, without limitation, immersion, flooding, air-atomized spraying, air-assisted spraying, airless spraying, high-volume low-pressure spraying and air-assisted airless spraying. The minimum contact time of the composition with the substrate is most broadly that time which is sufficient to form the desired passivate film thereon: that contact time can be as little as 1 second or as great as 15 minutes in that instance where the passivation or conversion treatment is being performed on metal that will be cold worked: however, dependent upon the pH and the concentration of the applied solution, a contact time of from 5 to 300 seconds, for example from 5 to 50 seconds, would be more typical. Moreover, the compositions are applied at a temperature ranging from 20° C. to 90° C., for instance from 30° C. to 80° C. or from 40° C. to 70° C.

At the conclusion of the passivation treatment, the article is extracted from the bath and dried using, for instance, ambient air drying, circulating warm air, forced air drying or infrared heating. It is not precluded that the article be subjected to: at least one water rinse to remove residual passivation composition therefrom; and/or, rinsing with a dilute silicate solution based on the aforementioned silicate compounds and having a temperature of from 20° C. to 70° C. The silicate compound can be present in the rinse solution in an amount of from 1 to 40 g/l, for example from 5 to 15 g/l, calculated as SiO2. The rinsed substrate may be dried after completion of the rinsing step(s) or, if applicable, after each rinse solution.

The composition according to the present invention yields a passivate film that is yellow, olive or black in color, with a flat to glossy finish. The exact nature of that finish is determined predominantly by the base substrate, the zinc or zinc alloy coating, and the immersion time in the conversion coating composition. Zinc or zinc alloy coatings chromated in accordance with the present invention exhibit corrosion protection to 50-96 hours before the observed onset of white rust corrosion, as defined by ASTM B-201. Alternatively or additionally, said zinc or zinc alloy coatings chromated in accordance with the present invention exhibit corrosion protection to 50-96 hours before the observed onset of white rust corrosion (as defined by ASTM B-201) when treated with neutral salt spray (NSS, 5 wt. % NaCl, 95 wt. % $H_2O$) under steady state conditions in accordance with the procedure of ASTM B-117.

The present invention does not preclude supplementary conversion coatings being applied to the passivate film obtained in accordance with the present invention; indeed, such supplementary coatings may further extend corrosion protection and improve the aesthetics of the finished article. Inorganic coatings based on silicates and organic conversion coatings based on epoxy resins might be mentioned as non-limiting examples of supplemental conversion coatings: reference in this regard may be made to inter alia U.S. Pat. No. 5,743,971 (Inoue) and U.S. Pat. No. 5,855,695 (McMillen). These supplemental conversion coatings may be applied by any suitable means known in the art, such as by dipping, spraying, electro-coating or powder coating.

The conversion coating(s) may constitute the topcoat applied to the substrate surface. Alternatively, the conversion coating(s) may serve: as an undercoat for paints, lacquers, inks or powder coatings; as a base to which polymers, such as rubber, may be bound; and/or, as a base to which adhesives or sealants may be applied.

Various features and embodiments of the disclosure are described in the following examples, which are intended to be representative and not limiting.

EXAMPLES

The following commercial products are used in the Reference Examples and Examples according to the invention: TD-1355-HM: Polymer resin available from Henkel Surface Technologies PVT Ltd.

Aqueous passivation compositions were prepared by mixing the ingredients given in Table 1 herein below:

TABLE 1

| Ingredient | Composition (g) Reference Example 1 | Reference Example 2 | Example 1 | Example 2 |
|---|---|---|---|---|
| Water | 36.1 | 48.9 | 67.8 | 66.3 |
| Chromium(6+)oxide | 6.8 | 9.6 | 7.5 | 7.5 |
| Phosphoric acid (85%) | 15.6 | 17.0 | 5.2 | 5.2 |
| Gluconic acid (50%, Technical Grade) | 4.0 | 0 | 0 | 0 |
| Chromium nitrate | 25.0 | 0 | 0 | 0 |
| 1-Hydroxyethylidene-1,1-Diphosphonic Acid (60%) | 0 | 0 | 7.5 | 7.5 |
| Aminotrimethylene phosphonic acid | 0 | 0 | 0 | 1.5 |
| Urea | 0.5 | 0 | 0 | 0 |
| TD-1355-HM * | 12 | 0 | 0 | 0 |
| Manganese (II) Oxide (MnO) | 0 | 0 | 2 | 2 |
| Hydrofluoric Acid (49%) | 0 | 2.0 | 0 | 0 |
| Hydrofluosilicic Acid (25%) | 0 | 15 | 0 | 0 |
| Sorbitol (70%) | 0 | 3.3 | 0 | 0 |
| Glycolic Acid (70%) | 0 | 4 | 10 | 10 |
| Zinc oxide (ZnO) | 0 | 0.031 | 0 | 0 |

* polymer resin available from Henkel Surface Technologies Pvt. Ltd., India

Based on these tabulated aqueous compositions, the following tests were performed.

Stability at pH 8.5: The pH of the aqueous compositions was raised to 8.5 through the addition of 0.1 M NaOH and visual observations made of any sedimentation and precipitation within the compositions after 10 min without stirring.

Standard Test Panel Preparation: Specimens of Advanced Coating Technology (ACT) G-90 hot dipped galvanized steel were mechanically cut into squares of 4 cm×4 cm dimensions. Each obtained panel was treated with an alkaline cleaner at 55° C. for 10 seconds, rinsed with tap water at room temperature and then dried by squeegeeing. The panels were then coated by a chemcoater/roll coater with each passivation composition selected for evaluation: duplicate panels were prepared for each passivation composition. The resultant coated test panels were then removed from the bath and baked to a peak metal temperature (PMT) of from 55-60° C. The obtained coating weight of the test panels was from 35-40 mg/m$^2$ of chromium.

Zinc Dissolution Panel Preparation: Specimens of Advanced Coating Technology (ACT) G-90 hot dipped galvanized steel were mechanically cut into squares of 4 cm×4 cm dimensions. Each obtained panel was treated with an alkaline cleaner at 55° C. for 10 seconds, rinsed with tap water at room temperature and then dried by squeegeeing. The panels were then separately immersed for 2 hours in a bath (volume 20 ml) of each passivation composition selected for evaluation. The resultant coated test panels were then removed from the bath. To then measure the amount of zinc which was dissolved during the formation of the conversion coating optical emission spectroscopy (ICP-OES) was applied.

Neutral salt spray (NSS): This test was carried out according to ASTM B117 with a 5% NaCl solution at 35° C. (https://www.astm.org/Standards/B117). The coated panels were disposed in the spray chamber (ERICHSEN Model 606/400 L) at 15-30° from the vertical for 96 hours. The test panels were not allowed to contact other surfaces in the chamber and condensed or corrosion products on their surfaces were not permitted to cross-contaminate each other. Photographic recording of the test panels was performed each 24 hours. After exposure, test panels were rinsed in deionized water to remove salt deposits from their surface and then immediately dried. From a visual inspection of the coated panels at 96 hours: i) coated panels for which less than 5% by area showed white rust were held to have passed said test; and ii) conversely, coated panels showing 5% by area of white rust were held to have failed said test.

The results of these tests are illustrated in Table 2 herein below.

TABLE 2

| Test Parameters | Reference Example 1 | Reference Example 2 | Example 1 | Example 2 |
|---|---|---|---|---|
| pH (25% v/v bath) | 1.04 | 1.60 | 2.62 | 2.38 |
| Total Acidity* of Composition (mg KOH/g) | 27-31 | 21-23 | 13-16 | 13-16 |
| Composition Stability at pH 8.5 | Precipitation | Precipitation | Stable, no precipitation | Stable, no precipitation |
| Bath Dissolved Zn (ppm) | 4587 | 6902 | 2106 | 2200 |
| Salt Spray Tests (ASTM B117) | Fail | Fail | Pass | Pass |

*titration end point at pH 8.2

In view of the foregoing description and examples, it will be apparent to those skilled in the art that equivalent modifications thereof can be made without departing from the scope of the claims.

What is claimed is:

1. An aqueous passivation composition for the treatment of zinc or zinc alloy coatings, said composition having a pH of less than 3 and comprising:

i) a source of trivalent chromium (Cr(III)) ions derived from hexavalent chromium ions (Cr(VI)) and at least one reducing agent present in a stoichiometric excess of up to 1 mol. % relative to the hexavalent chromium ions (Cr(VI));

ii) at least one a-hydroxycarboxylic acid represented by general formula (I):

$$R_1CH(OH)COOH \quad (I)$$

wherein: $R_1$ represents a hydrogen atom, a C1-C4 alkyl group, a C2-C6 alkenyl group, a C1-C6 alkoxy group, a $C_3$-$C_6$ cycloalkyl group or a C6-C10 aryl group;

iii) phosphoric acid;

iv) at least one water-soluble polyphosphonic acid or a water-soluble salt thereof, wherein said polyphosphonic acid corresponds to general formula (II):

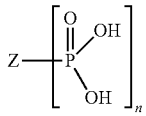

(II)

in which:

n is at least 2; and

Z is a connecting organic moiety having an effective valency of n, said polyphosphonic acid comprising at least two phosphonic groups separated by an alkylene bridge having 1 or 2 carbon atoms ($C_1$-$C_2$ alkylene), the at least one water-soluble polyphosphonic acid including 1-hydroxyethylidene-1,1-diphosphonic acid and aminotrismethylene phosphonic acid in a lesser amount by weight than the 1-hydroxyethylidene-1,1-diphosphonic acid;

v) at least one divalent metal cation; and vi) unexhausted reducing agent;

wherein said composition is substantially free of nitrate and fluoride anions and is substantially free of hexavalent chromium (Cr(VI)).

2. The composition according to claim 1, wherein the source of trivalent chromium ions comprises a salt selected from the group consisting of: chromium sulfate ($Cr_2(SO_4)_3$); chromium alum ($KCr(SO_4)_2$); chromium chloride ($CrCl_3$); and chromium bromide ($CrBr_3$).

3. The composition according to claim 1, wherein the at least one reducing agent is present in an amount sufficient to ensure complete reduction of the hexavalent chromium ions (Cr(VI)) to trivalent chromium ions; and the only divalent metal cations added consist of v) said at least one divalent metal cation selected from the group consisting of: $Mg^{2+}$; $Ca^{2+}$; $Mn^{2+}$; $Sr^{2+}$; $Ba^{2+}$ and mixtures thereof.

4. The composition according to claim 3, wherein:

said source of hexavalent chromium ions (Cr(VI)) is selected from the group consisting of chromium (VI) oxide, alkali metal chromates, alkali metal dichromates and combinations thereof.

5. The composition according to claim 3, wherein said reducing agent includes hydrazine, hydroxylamine, alkali metal iodides, tin(II) compounds, or antimony (III) compounds.

6. The composition according to claim 1, wherein the concentration of trivalent chromium ions (Cr(III)) is from 0.005 to 0.1 moles/liter.

7. The composition according to claim 1, wherein said at least one α-hydroxycarboxylic acid is selected from the group consisting of: glycolic acid; lactic acid (2-hydroxypropanoic acid); 2-hydroxybutanoic acid; 2-hydroxypentanoic acid; 2-hydroxyhexanoic acid; and mixtures thereof.

8. The composition according to claim 1, wherein having regard to the carboxylic acid groups provided by said at least one α-hydroxycarboxylic acid, the molar ratio of said carboxylic acid groups to chromium (Cr) is in a range from 1:10 to 1:2.

9. The composition according to claim 1, wherein said at least one polyphosphonic acid or the water soluble salt thereof is present in the composition in an amount such that a molar ratio of phosphonate groups to phosphoric acid ($H_3PO_4$) in the composition is in a range from 1:0.75 to 1:1.25.

10. The composition according to claim 1, wherein said at least one divalent metal cation is selected from the group consisting of: $Mg^{2+}$; $Ca^{2+}$; $Mn^{2+}$; $Sr^{2+}$; $Ba^{2+}$; $Zn^{2+}$ and mixtures thereof.

11. The composition according to claim 1, wherein said at least one divalent metal cation is present in the aqueous passivation composition at a molar concentration in a range from 0.01 to 1 moles/litre.

12. The composition according to claim 1 being substantially free of peroxide and persulphate compounds.

13. The composition according to claim 1, wherein said at least one polyphosphonic acid or the water-soluble salt thereof is present in the composition in an amount such that a molar ratio of phosphonate groups to phosphoric acid ($H_3PO_4$) in the composition is in a range from 1:0.8 to 1:1.2.

14. The composition according to claim 1, wherein said alkylene bridge having 1 or 2 carbon atoms is interrupted by one or more heteroatoms selected from N or O.

15. A process for imparting a chromate passivate film to a substrate to which a zinc or zinc alloy coating has been applied to at least one surface thereof, said process comprising contacting at least one zinc or zinc alloy coated surface of the substrate with an aqueous composition according to claim 1, at a temperature ranging from 20° C. to 90° C. for a period of time sufficient to form a passivate film thereon.

16. An aqueous passivation composition for the treatment of zinc or zinc alloy coatings comprising:

i) reducing hexavalent chromium (Cr(VI)) with a reducing agent to provide trivalent chromium (Cr(III)) ions, present in a concentration of from 0.005 to 0.1 moles/liter, the reducing agent being provided in an amount sufficient to ensure complete reduction of the hexavalent chromium ions (Cr(VI)) to trivalent chromium ions;

ii) a α-hydroxycarboxylic acid and a further carboxylic acid, wherein said α-hydroxycarboxylic acid is selected from the group consisting of glycolic acid, lactic acid, 2-hydroxybutanoic acid, 2-hydroxypentanoic acid and 2-hydroxyhexanoic acid, and the further carboxylic acid is selected from the group consisting of formic acid; acidic acid; propionic acid; butyric acid; iso-butyric acid; valeric acid; hexanecarboxylic acid; cyclopentanecarboxylic acid; acetylsalicylic acid; benzoic acid; nitrobenzoic acid; 3,5-dinitrobenzoic acid; sorbic acid; trifluoracetic acid; 2-ethylhexanoic acid; acrylic acid; chloroacetic acid; 2-chlorobenzoic acid; 2-chloro-4-nitrobenzoic acid; cyclopropanecarboxylic acid; methacrylic acid; 3-nitrobenzoic acid; phenoxyacetic acid; isovaleric acid; pivelinic acid; 2-ethyl-butyric acid; furan-2-carboxylic acid; bromoacetic acid; crotonic acid; 2-chloropropionic acid; dichloroacetic acid; glyoxylic acid; 4-methoxybenzoic acid; 3,4-dimethoxybenzoic acid; levulinic acid; pentenoic acid; phenylacetic acid; tiglic acid; and vinylacetic acid, wherein a molar ratio of carboxylic acid groups provided by said α-hydroxycarboxylic acid to chromium (Cr) is in a range from 1:10 to 1:2, and said further carboxylic acid is present in an amount up to 10 mol. % based on a total number of moles of the a-hydroxycarboxylic acid;

iii) phosphoric acid;

iv) at least one water-soluble polyphosphonic acid or a water-soluble salt thereof, wherein said polyphosphonic acid is selected from a group consisting of aminotris (methylene phosphonic acid) (ATMP), 1-hydroxyethylidene-1,1-diphosphonic acid (HEDP), hexamethylene diamine tetra (methylene phosphonic acid) (HDTMP), diethylenetriamine penta (methylene phosphonic acid), diethylenetriamine penta (methylenephosphonic acid (DTPMP) and mixtures thereof; and wherein said at least one polyphosphonic acid or the water-soluble salt thereof is present in the composition in an amount such that a molar ratio of phosphonate groups to phosphoric acid ($H_3PO_4$) in the composition is in a range from 1:0.75 to 1:1.25; and v) $Mn^{2+}$ cations and optionally at least one additional divalent metal cation selected from the group consisting of $Mg^{2+}$, $Ca^{2+}$, $Sr^{2+}$, $Ba^{2+}$ and $Zn^{2+}$, wherein a molar concentration of the divalent metal cations in the aqueous passivation composition is in a range from 0.01 to 1 moles/liter.

17. The composition according to claim 16, wherein said at least one polyphosphonic acid or the water-soluble salt thereof is present in the composition in an amount such that a molar ratio of phosphonate groups to phosphoric acid ($H_3PO_4$) in the composition is in a range from 1:0.9 to 1:1.1.

18. The composition according to claim 17, wherein said polyphosphonic acid is selected from the group consisting of: aminotris (methylene phosphonic acid) (ATMP); 1-hydroxyethylidene-1,1-diphosphonic acid (HEDP) and mixtures thereof.

19. An aqueous passivation composition for the treatment of zinc or zinc alloy coatings, said composition consisting of:

i) a source of trivalent chromium (Cr(III)) ions present in a concentration of from 0.005 to 0.1 moles per liter;

ii) one or more α-hydroxycarboxylic acid represented by general formula (I):

$$R_1CH(OH)COOH \quad (I)$$

wherein: $R_1$ represents a hydrogen atom, a C1-C4 alkyl group, a C2-C6 alkenyl group, a C1-C6 alkoxy group, a $C_3$-$C_6$ cycloalkyl group or a C6-C10 aryl group, the one or more α-hydroxycarboxylic acid present in an amount such that a molar ratio of carboxylic acid groups to chromium (Cr) is in a range from 1:10 to 1:2;

iii) phosphoric acid present in an amount such that the flu is from 1 to 3;

iv) one or more water-soluble polyphosphonic acids or one or more water-soluble salts thereof present in an amount such that a molar ratio of phosphonate groups to phosphoric acid ($H_3PO_4$) in the composition is in a range from 1:0.75 to 1:1.25, wherein said one or more polyphosphonic acids corresponds to general formula (II):

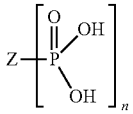

(II)

in which:

n is at least 2; and

Z is a connecting organic moiety having an effective valency of n, said one or more polyphosphonic acid comprising at least two phosphonic groups separated by an alkylene bridge having 1 or 2 carbon atoms ($C_1$-$C_2$ alkylene), wherein said one or more polyphosphonic acids or the one or more water-soluble salts thereof is present in the composition in an amount such that a molar ratio of phosphonate groups to phosphoric acid ($H_3PO_4$) in the composition is in a range from 1:0.75 to 1:1.25;

v) a source of a divalent metal cation is present in an amount of 0.01 to 1 moles per liter;

wherein said composition is substantially free of nitrate and fluoride anions and is substantially free of hexavalent chromium (Cr(VI)); and vi) water.

20. The aqueous passivation composition of claim 19, wherein i) the source of trivalent chromium (Cr(III) ions is chromium (6+) oxide; ii) the one or more α-hydroxycarboxylic acid is glycolic acid; iv) the one or more water-soluble polyphosphonic acids are 1-hydroxyethylidene-1,1-diphosphonic acid and aminotrismethylene phosphonic acid; and v) the source of the divalent metal cation is MnO.

* * * * *